US006836979B2

(12) United States Patent
Flavio et al.

(10) Patent No.: US 6,836,979 B2
(45) Date of Patent: Jan. 4, 2005

(54) SHOE STRUCTURE

(76) Inventors: Bacchiega Flavio, Via Solferino, 5 -, I 31044 Montebelluna (IT); Calvani Romano, Via Civitanova, 162, -, I 62012 Civitanova Marche (IT)

( * ) Notice: Subject to any disclaimer, the term of this patent is extended or adjusted under 35 U.S.C. 154(b) by 0 days.

(21) Appl. No.: 10/435,630

(22) Filed: May 10, 2003

(65) Prior Publication Data

US 2004/0098881 A1 May 27, 2004

(30) Foreign Application Priority Data

Nov. 27, 2002 (IT) ..... BG2002A000039

(51) Int. Cl.[7] ..... A43B 13/14; A43B 23/00
(52) U.S. Cl. ..... 36/103; 36/45; 36/4; 12/142 E
(58) Field of Search ..... 36/103, 45, 4, 36/97, 7.3, 9 R, 31; 12/142 E, 142 RS

(56) References Cited

U.S. PATENT DOCUMENTS 3,404,468 A * 10/1968 Henri ..... 36/11
3,724,104 A * 4/1973 Eder et al. ..... 36/14
4,676,010 A 6/1987 Cheskin
4,858,341 A * 8/1989 Rosen ..... 36/97
5,077,915 A 1/1992 Gross
5,325,614 A * 7/1994 Rosen ..... 36/97
5,367,791 A * 11/1994 Gross et al. ..... 36/31
5,815,949 A * 10/1998 Sessa ..... 36/3 B
6,018,889 A * 2/2000 Friton ..... 36/28
6,226,896 B1 * 5/2001 Friton ..... 36/28
6,237,255 B1 * 5/2001 Renaudin et al. ..... 36/97
6,279,251 B1 * 8/2001 Davis ..... 36/97

FOREIGN PATENT DOCUMENTS

| | | |
|---|---|---|
| DE | 3536557 A1 | 10/1985 |
| EP | 1158868 | 12/1963 |
| EP | 0 890 321 A2 | 1/1999 |
| WO | WO 98/39984 | 3/1997 |
| WO | WO 90/09113 | 1/1999 |

* cited by examiner

*Primary Examiner*—Ted Kavanaugh
(74) *Attorney, Agent, or Firm*—Bryan Cave LLP

(57) ABSTRACT

Shoe structure comprising a first subset apt to be a foot-containing structure and a second subset which can be coupled to the first subset and apt to isolate, at least partially, the foot sole from the ground. The first subset comprises a first insole, at least partially made of an elastically deformable material, and one or more edges, at least partially made of an elastically deformable material, which extend from said first insole and form a shoe upper which can at least partially wrap the foot upper portion; the second subset comprises a supporting framework, at least partially made of an elastically deformable material, having an upper face which can be coupled to said first subset and a lower face with one or more inserts which are intended to be in contact with the ground.

24 Claims, 6 Drawing Sheets

SHOE STRUCTURE

DESCRIPTION

The present invention concerns a shoe structure, which can be used, for instance, for free time, or for sports, or, more generally speaking, for walking.

Shoe structures presently used are generally composed of a soft shoe upper connected to a lower shoe sole apt to be in contact with the ground, thus protecting the foot sole. Furthermore, flexible soles are commonly in use, said soles being able to bend, thus allowing to raise the heel relative to the toes, and ensuring comfortable walking.

Since they must guarantee an adequate protection of the foot sole, said known soles are usually made of materials having a certain rigidity. Analogously, known shoe uppers are made of at least a layer of an usually rigid or semi-rigid material, such as e.g. leather, imitation leather or plastic materials, which can be preformed according to a wished shape.

Shoes provided with a soft upper also known, such as for instance shoes with a fabric upper. Said shoes are neither particularly strong nor usually waterproof, and they are commonly used as house shoes, for instance as slippers.

The main disadvantage of the aforesaid known shoes is that they must be formed as much as possible according to the shape of the user's foot, in order to be comfortably worn. To this aim shoes of different dimensions for feet of different sizes are commercially available.

Furthermore, shoes of known type are also produced in intermediate sizes, namely comprised between two subsequent sizes, in order to allow the user to choose the most comfortable size among those available.

From the aforesaid it is clear that normal shoes involve some problems for both the producer and the seller, since for the producers, the distributors and, above all, for the sales outlets it is difficult to manage the supplies effectively, which difficulty often implies a reduced choice for the customers.

From the user's point of view, known shoes are usually never perfectly adaptable to the foot of each single user, since they are made according to production criteria aiming to obtain an average product taking into account several possible foot morphological characteristics. Moreover, the shoe inner volume is constant, whereas the volume taken up by the user's foot can vary, for example according to the thickness of the stocking or according to physiological factors producing swelling of lower limbs with variations of the foot volume during the day. Furthermore, in growing subjects, such as children or adolescents, the foot dimensions vary, even remarkably, in relatively short periods of time, thus making the shoes unusable before the end of their service life determined by wear and aging of the shoe. Finally, it must be considered that, due to the natural morphological asymmetry of the human body, each person is usually provided with a foot (normally the right one) which is slightly bigger than the other. Furthermore, inner shoes for sports shoes are also known, particularly for ski boots or for skates, made of two different elements which are connected by means of a further elastically deformable element. In this way the inner shoe is apt to be used together with a sports shoe provided with a rigid casing, at least longitudinally adjustable in order to allow the shoe to be worn by feet of two or more different sizes. A material disadvantage of this known embodiment is that it can be used only together with a rigid casing acting as a supporting framework. In fact, said inner shoe is not apt to walking, since it is formed by an upper and a sole, possibly integral to each other, made of soft fabric, or in any case not apt to touch the ground and/or to support adequately the foot during walking.

An object of the present invention is to solve the aforesaid technical problems, thus avoiding the disadvantages of the aforementioned prior art and providing a shoe structure usable with a maximum comfort by persons having feet with different size and shape.

Within the scope of this aim, one of the objects of the present invention is to provide a shoe structure allowing a remarkable reduction of production, transport and stocking costs.

Another important object is to provide a shoe sole structure having particular characteristics and framework which allows the production of a shoe with the aforesaid characteristics.

A further object of the present invention is to provide a method for producing a shoe structure having the aforesaid characteristics, said method being easy and economical.

Another object of the present invention is to provide a shoe structure and a relating production method which is highly reliable, easily executed and with competitive costs.

These and other objects which will be described in greater detail hereinafter, are achieved by means of a shoe structure comprising a first subset apt to form a foot-containing structure and a second subset which can be coupled to the first subset and apt to isolate, at least partially, the foot sole from the ground; the shoe structure according to the invention is characterized in that said first subset comprises a first insole, at least partially made of an elastically deformable material, and one or more edges, at least partially made of an elastically deformable material, extending from said first insole and forming a shoe upper which can at least partially wrap the foot upper portion, and it is further characterized in that said second subset comprises a supporting framework, at least partially made of an elastically deformable material and having an upper face, which can be coupled to said first subset, and a lower face with one or more inserts which are intended to be in contact with the ground.

In this way, thanks to its innovative structure, suitably combining subsets at least partially made of an elastically deformable material, the shoe according to the invention can be suited to feet having different dimensions and shape.

Further characteristics and advantages will be clearer from the description of preferred but not exclusive embodiments of the shoe structure according to the invention, which is described for illustrative but not limitative purposes with the help of the attached drawings, wherein.

Figure 1:
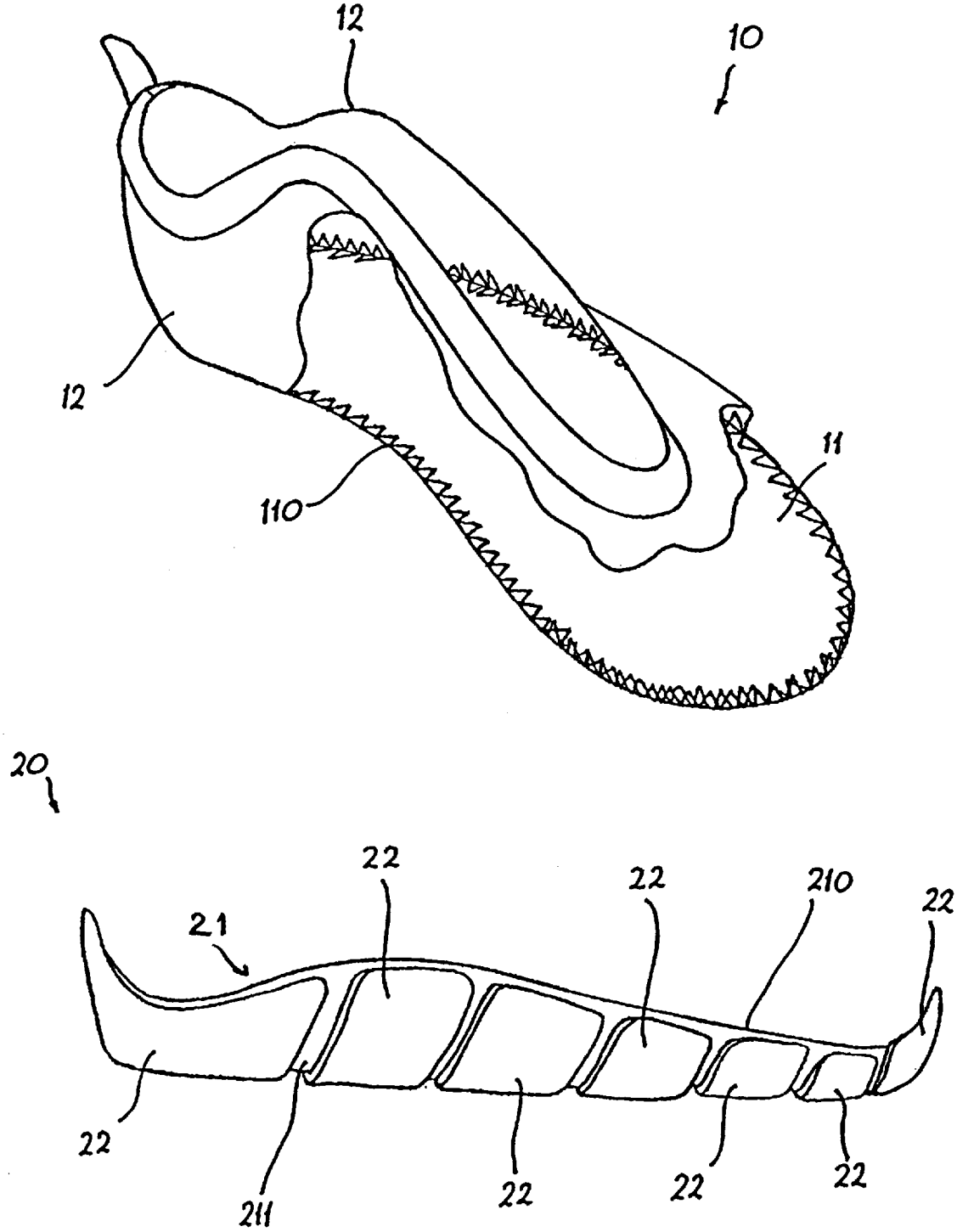
FIG. 1 shows some elements of a shoe structure according to the invention.

With a reference to the aforesaid figures, the shoe structure according to the invention comprises a first subset 10 and a second subset 20. The first subset 10 is apt to form a foot-containing structure, whereas the second subset 20 can be coupled to the first subset 10 and is apt to isolate at least partially the foot sole from the ground.

Said first subset 10 particularly comprises a first insole 11, at least partially made of an elastically deformable material, for example materials commercially available with trade names such as Lycra, Meryl, Cordura or the like, or more in general, materials comprising fibres or fabrics at least partially made of an elastomeric material.

Above the insole 10 one or more edges 12 are extended, at least partially made of an elastically deformable material, which can have different shapes according to the kind of shoe, for instance sneakers, sports shoes, children's shoes, boots, and having a shoe upper which can at least partially wrap the foot upper portion.

The second subset 20 comprises a supporting framework 21, at least partially made of an elastically deformable material, e. g. natural rubber, or of a PU, TR, PUR elastomer, or of light cross-linked rubbers. This ensures a high elastic deformability of the supporting framework 21 in longitudinal and/or transversal direction. The supporting framework 21 has an upper face 210 which can be coupled to the first subset 10, and a lower face 211 with one or more, preferably a plurality of, inserts 22 intended to be in contact with the ground. The inserts 22 can be advantageously made of highly abrasion-resistant materials.

Figure 2:
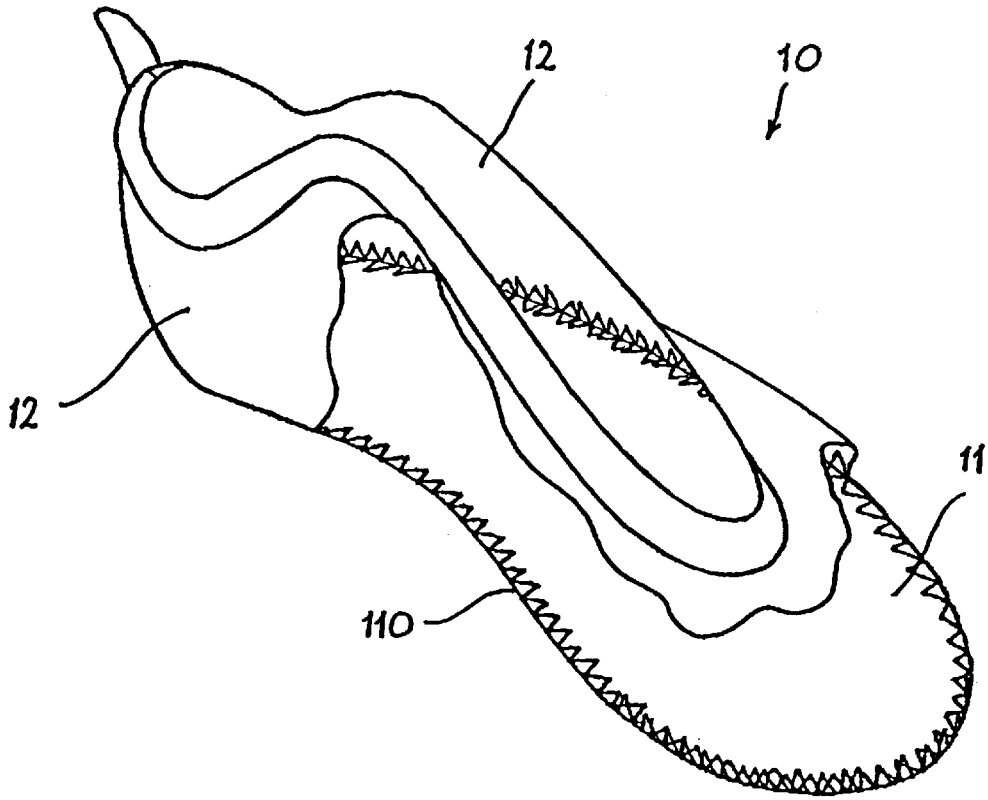
FIG. 2 shows some elements of a possible embodiment of a shoe structure according to the invention.
Figure 2:
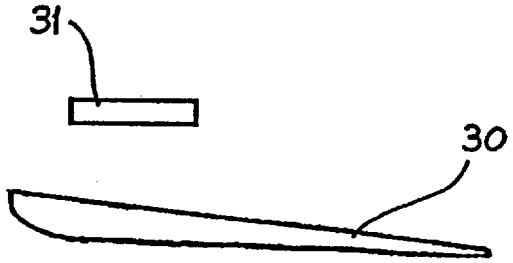
Figure 2:
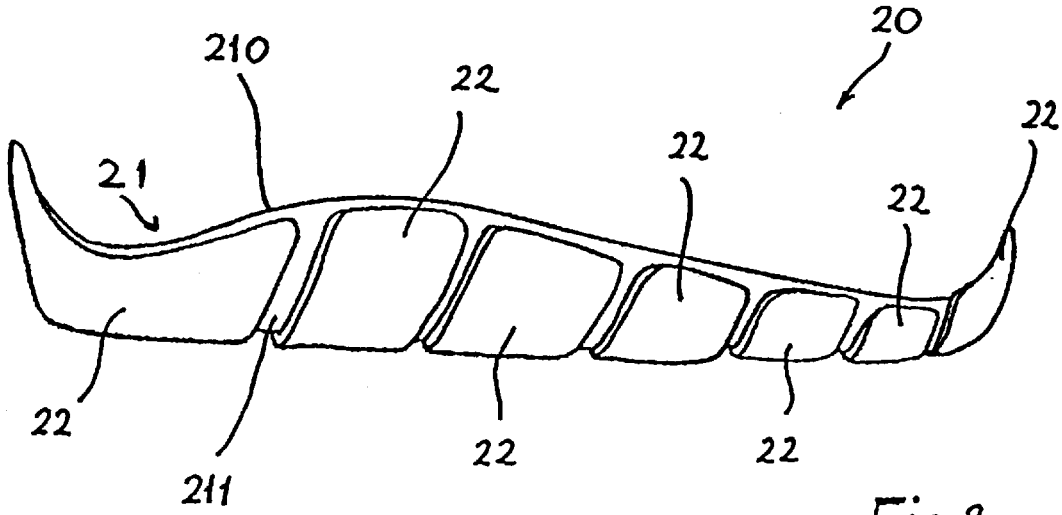
Figure 3:
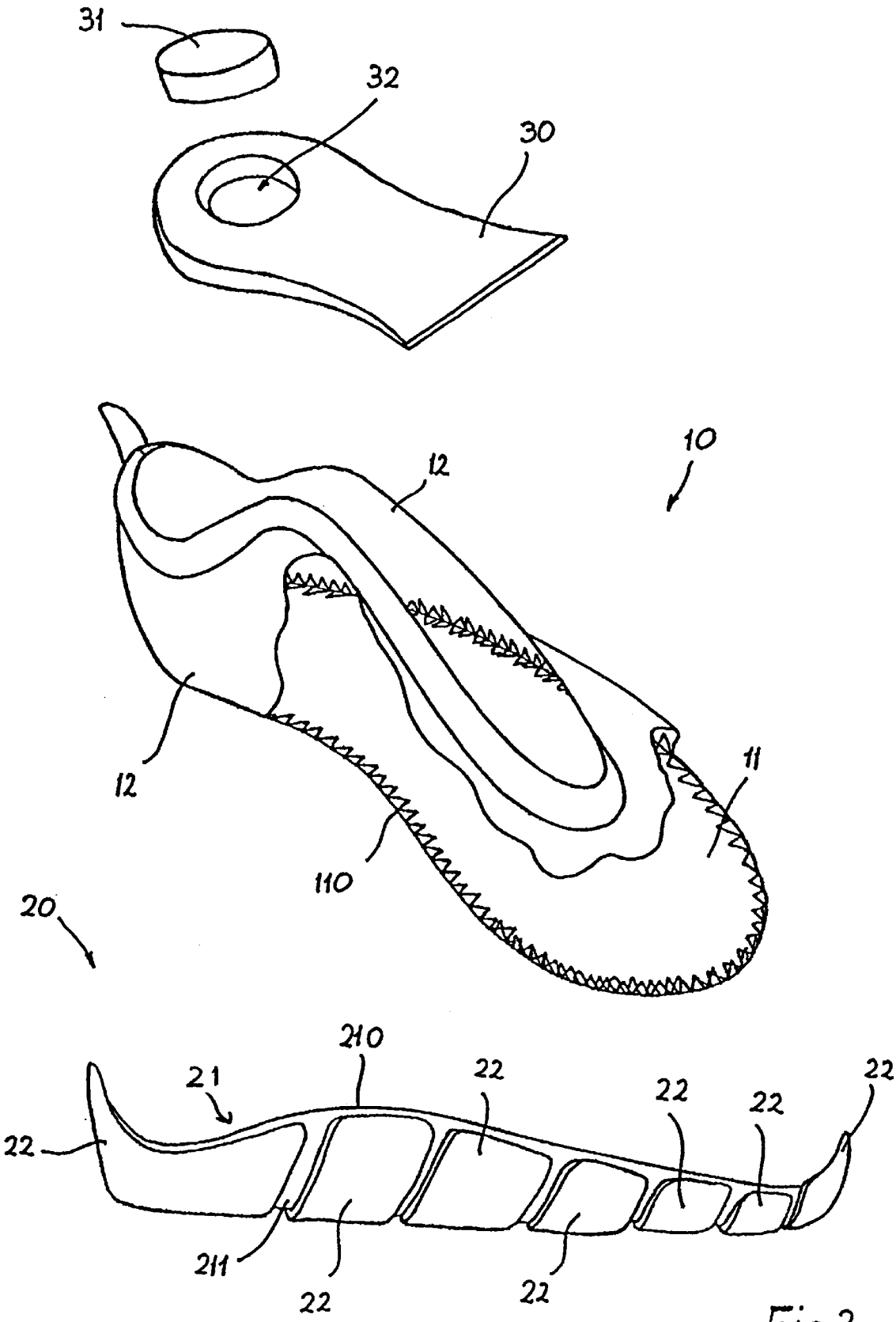
FIG. 3 shows some elements of an embodiment of the shoe structure according to the invention, which is an alternative to the embodiment of FIG. 2.

Preferably, according to FIGS. 1–3, the edges 12 are connected to the first insole 11 corresponding to its outer edge 110. The connection between the parts and the insole can be made, for instance, by means of a Strobel sewing made of an at least partially elastic thread, or by glueing, or even by means of a combination of these two methods, or by means of other known methods.

As previously stated, the edges 12 are defined and/or assembled together in order to form a shoe upper at least partially wrapping the foot upper portion; however, it is possible that these edges 12 extend beyond the foot, thus wrapping also a lower portion of the leg, for example obtaining a shoe structure corresponding to a boot. Therefore, the first subset 10 substantially represents a foot-containing structure which is advantageously elastically deformable both in the longitudinal and in the transversal direction, thus allowing great comfort to the user's foot. Furthermore, a second foot-supporting insole can be advantageously placed inside said first subset.

Preferably, the shoe structure according to the invention also comprises a heel-supporting element 30. Advantageously, a seat 32 apt to accommodate a shock absorber 31 is provided in said supporting element 30. The supporting element 30 can advantageously be made of EVA (ethylene-vinyl acetate) or PU (polyurethane) resin, whereas the element 31 can be made of, for example, elastomeric gel o similar materials.

Figure 4:
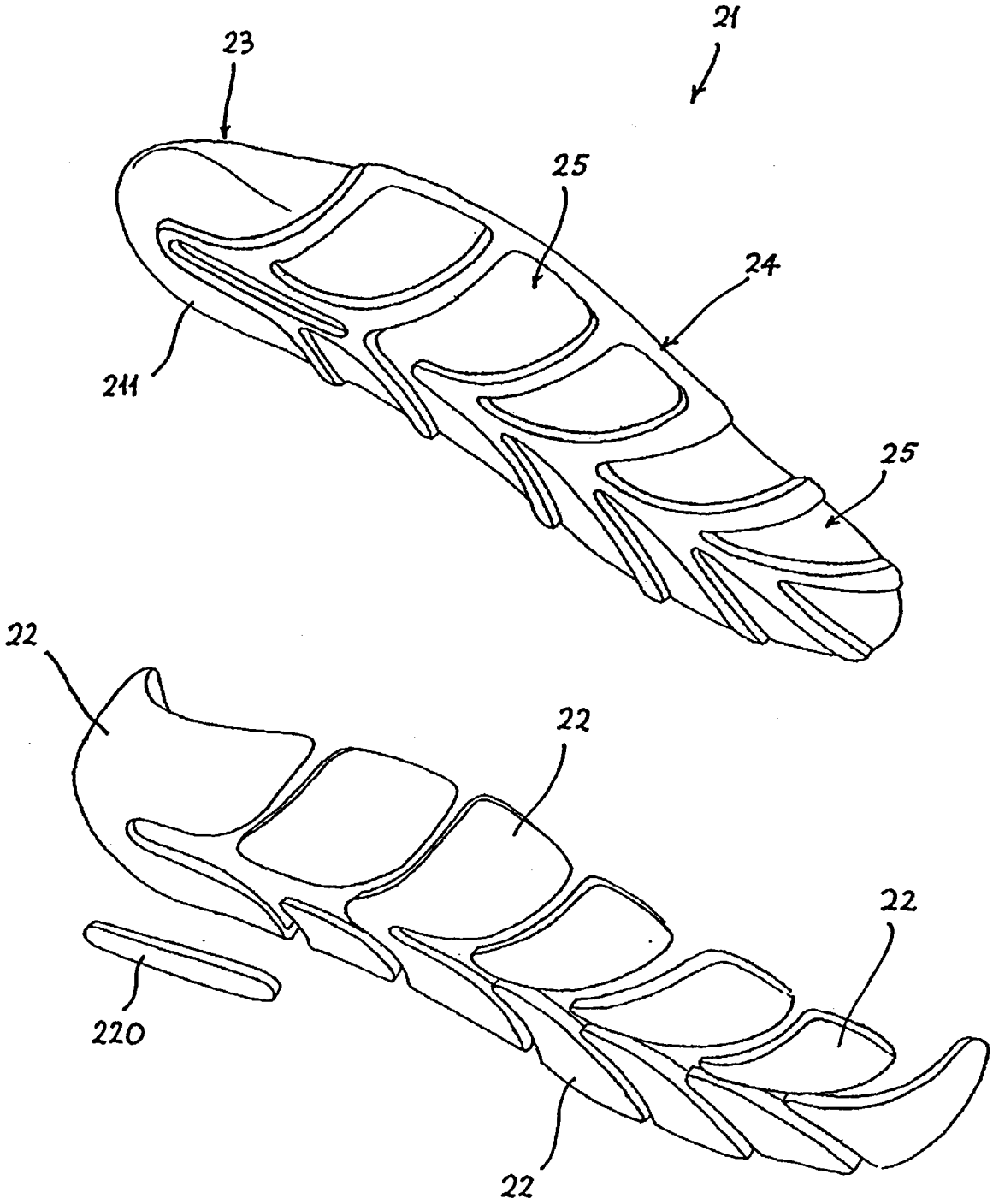
FIG. 4 is a prospective view of the elements of one of the subsets forming the shoe structure according to the invention.
Figure 5:
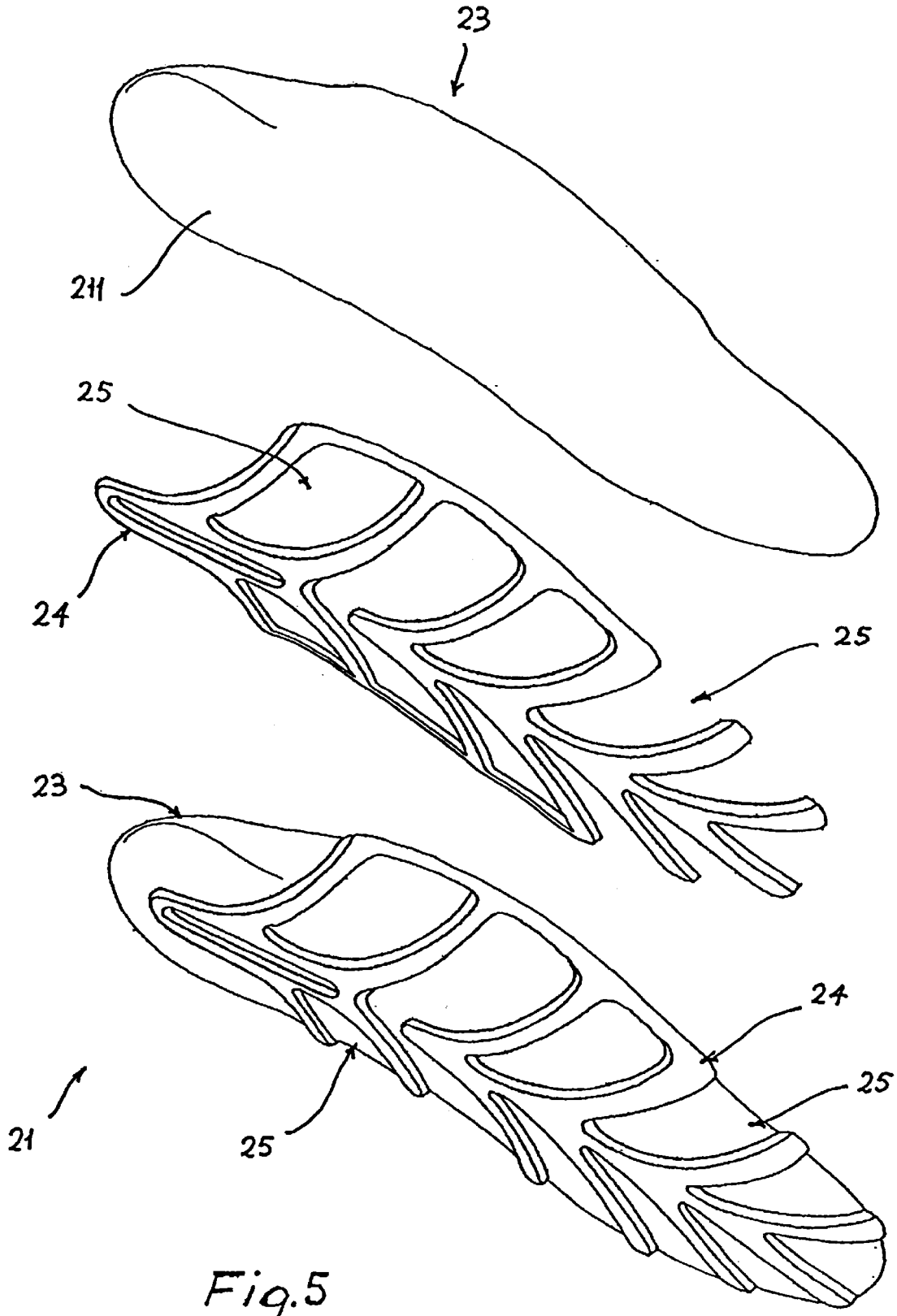
FIG. 5 is a prospective view of some elements of a shoe sole structure according to the invention.

Advantageously, as particularly shown in FIGS. 4 and 5, the supporting framework 21 comprises a basis 23 and a grid 24 placed on the lower face 211 of the basis 23. The basis 23 is at least partially made of an elastically deformable material, and the grid 24 is also at least partially made of an elastically deformable material which can be the same or different from the material used for the basis 23.

As clearly shown in FIGS. 4 and 5, the grid 24 forms on the lower face 211 of the basis 23 a plurality of seats apt to accommodate the inserts 22.

As shown in FIG. 5, the grid 24 can be formed by a continuous structure comprising a plurality of segments, all directly or indirectly connected to each other, thus forming a series of spaces which are the seats 25 of the inserts 22. According to an alternative embodiment, not shown in the drawing, the grid 24 can be formed by a plurality of segments which do not constitute a continuous structure because they are not all connected together, directly or indirectly, but which form a plurality of seats 25 for said inserts 22.

Preferably, the basis 23 and the grid 24 are made of the same material and form a single body obtained by moulding.

The inserts 22 have preordained shapes and geometrical patterns, and are preferably made of a highly abrasion-resistant material, e.g. ECO (epiclorohydrin), CSM (hypalon), CR (neoprene), SBR (styrene-butadiene) resins or the like. It must be remarked that the inserts 22 can also show diversified mechanical properties and/or they can be made of different materials according to the corresponding foot area where they must be placed and according to the use foreseen for the shoe.

For example, if the shoe is intended for sports, the inserts placed in a position corresponding to the foot sole can have a higher thickness and/or rigidity if compared to the inserts which must be placed in a position corresponding to the arch of the foot. Furthermore, always as an example, the abrasion-resistant characteristics of sneakers can be different from those of sports shoes.

Advantageously, a part of the inserts 22 can be at least partially made of elastomeric material. In this case, the correct positioning of these at least partially elastomeric inserts 220, for example in the heel area, allows them to work as shock absorbers.

The second subsets 20 having a structure of the aforesaid kind form a definitely innovative shoe sole structure and are an integral part of the present invention.

In fact, according to a particular aspect, the present invention also concerns a shoe sole structure comprising a supporting framework 21, at least partially made of an elastically deformable material and having an upper face 210 which can be coupled to the body of said shoe and a lower face 211 with a plurality of inserts 22 which are intended to be in contact with the ground.

As previously stated, the supporting framework 21 preferably comprises a basis 23 and a grid 24 placed on its lower face 211. The grid 24 forms a plurality of seats 25 apt to accommodate said inserts 22 and is preferably made as a single piece with said basis 23. Both the basis 23 and the grid 24 are at least partially made of an elastically deformable material, therefore ensuring a high elastic deformability in the longitudinal and/or transversal direction to the sole structure according to the invention.

At least a part of the inserts 22 are made of a highly abrasion-resistant material, as previously described. Moreover, a part of the inserts 22 can perform the aforesaid shock-adsorbing function by means of a suitable choice of the elastomeric materials constituting said inserts and by means of their correct positioning.

The assembling of the shoe structure according to the present invention foresees that the first subset 10 is connected to the second subset 20. As shown in FIG. 1, said connection can be advantageously carried out by a direct coupling of the first insole 11 to the upper face 210 of said supporting framework 21.

According to an embodiment shown in FIG. 2, the heel-supporting element 30 is placed between said first insole 11 and the upper face 210 of said supporting framework. Alternatively, as shown in FIG. 3, the heel-supporting element 30 can be placed inside said first subset 10, in a position corresponding to the internal surface of the fist insole 11; if also the second insole is present, the supporting element 30 is preferably interposed between said second insole and the first insole 11.

According to a further particular aspect, the present invention also concerns a method for the production of a shoe structure as previously defined. In fact, it has been remarked that the use of suitable measures and of a suitable assembling sequence allows the production of a shoe structure according to the invention in a particularly easy, quick and economical way.

Therefore, a further object of the present invention is a method for providing the aforesaid shoe structure characterized in that it comprises, in any order, the following steps:

a) providing the first subset 10;

b) providing the second subset 20;

and then the following step:

c) assembling of the first subset 10 and the second subset 20, said step a) comprising, in any order, the following steps:

a. 1) definition and/or assembling of one or more parts 12, at least partially made of an elastically deformable material, in order to obtain a shoe upper which can at least partially wrap the foot upper portion;

a.2) definition of a first insole 11 at least partially made of an elastically deformable material;

and then:

a.3) assembling of said insole 11 with said edges 12 in order to obtain a foot-containing structure;

said step b) comprising, in any order, the following steps:

b.1) providing one or more inserts 22 suitable to be in contact with the ground;

b.2) providing a supporting framework 21 having an upper face 210 which can be coupled to said first subset 10 and a lower face which can be coupled to said one or more inserts 22, said supporting structure 21 being at least partially made of an elastically deformable material;

and then b.3) assembling of said supporting framework 21 with said one or more inserts 22.

Preferably, step c) comprises the following steps:

c.1) assembling of a third supporting insole 111 to the first subset 10, in a position corresponding to the internal surface of the first insole 11,;

c.2) coupling between the first subset 10 and the second subset 20;

and possibly:

c.3) removal of said supporting insole 111.

Figure 6:
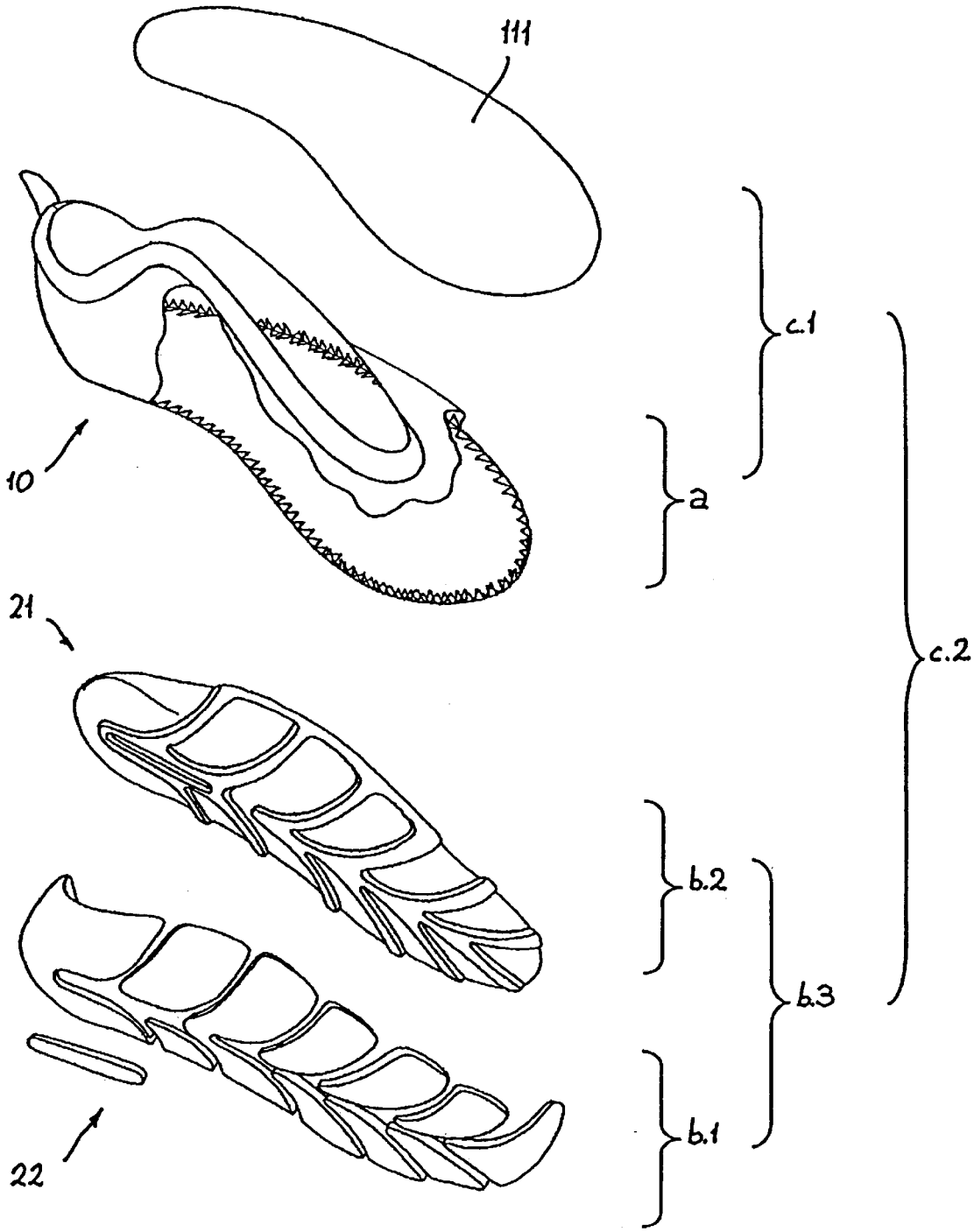
FIG. 6 shows some steps of the method for providing a shoe structure according to the invention.

The method according to the present invention will be described hereinafter with a reference to FIG. 6, which schematically shows some steps performed in said method.

Step a) comprises a step a.1) defining a shoe upper which can at least partially wrap the foot upper portion by means of a suitable dimensioning and/or assembling of one or more edges 12 and a step a.2) defining an insole 11. Both the edges 12 and the insole 11 are at least partially made of elastically deformable materials. Steps a.1) and a.2) can be carried out in any order.

Thereafter, step a.3) foresees that the insole 11 is assembled to the edges 12, for example by means of a Strobel sewing with an at least partially elastic thread, thus obtaining a foot-containing structure which is elastically deformable both in the longitudinal and in the transversal direction.

Step b) comprises a step b.1) of providing one or more inserts 22 having predefined shapes and geometrical patterns and preferably made of the previously described materials; said providing advantageously takes place by means of a moulding process, preferably by means of an open mould.

Furthermore, step b) comprises a step b.2) for providing a supporting framework 21 at least partly made of an elastically deformable material. As previously stated, the supporting framework 21 comprises a basis 23 and a grid 24 forming a plurality of seats 25 apt to accommodate the inserts 22. The grid 24 can be formed as a single element with the basis 23 by means of a single moulding step, or separately by means of several subsequent moulding steps. Steps b.1) and b.2) can be carried out in any order.

Afterwards, step b.3) foresees the assembling between the supporting framework 21 and the inserts 22. Said assembling preferably takes place by hot pressing in an open mould and is followed by a step b.4) wherein the thus obtained structure is vulcanised. Step b) thus allows to produce a sole structure which is advantageously elastically deformable, both in the longitudinal and in the transversal direction.

Steps a) and b) can be carried out in any order. Successively, step c) foresees the assembling of the subsets 10 and 20, respectively obtained from steps a) and b).

Preferably, step c) foresees a first step c.1) wherein a third supporting insole 111 is connected to the subset 10 in the position corresponding to the internal surface of the first insole 11. Step c.1) is particularly advantageous, since the third insole 111, during the steps preparing the assembling of the containing structure 10 and the sole 20, avoids the curl of the structure 10 because of the effect of the elastic materials used for the edges 12 and for the insole 11. The third insole 111 advantageously consists of an inextensible material and its assembling to the subset 10 preferably takes place together with the assembling of the insole 11 to the edges 12. Afterwards, with step c.2), the first and the second subset 10 and 20 are assembled together, thus forming a shoe structure according to the invention. In case, at the end it is foreseen a step c.3) for removing the third supporting insole 111.

In the practice it has been observed that the shoe structure, the sole structure and the method according to the invention fully perform the predetermined task, giving remarkable advantages and improvements if compared with the prior art. In fact, as previously described, the shoe structure according to the invention is advantageously elastically extensible both in the longitudinal and in the transversal direction, thus allowing its comfortable use with feet having different dimensions and shapes. It is thus guaranteed a certain comfort to the user and, at the same time, the reduction of the aforesaid logistic problems concerning production, stocking, transport and sale. If the user is a growing subject, the extensibility of the shoe structure according to the invention allows the shoe to follow the foot in its development for a time longer than that allowed by normal footwear, thus prolonging the period of use of said shoe.

The particular shoe sole structure according to the invention allows, thanks to the combined presence of the supporting framework and of the inserts, a good longitudinal and/or transversal extensibility and at the same time an adequate protection of the foot sole and an adequate comfort and efficiency during walking.

Finally, the method of production of a shoe structure according to the invention turns out to be particularly advantageous because it allows the separate production of the two subsets and their successive assembling according to an easy and economical sequence, thus minimizing the required steps.

The devised sole structure, shoe structure and method can be subjected to modifications and variations, all within the scope of the invention. Furthermore, all details can be replaced by technically equivalent elements. In the practice, any material, provided that it is compatible with the specific use, and any dimension is allowed, according to the requirements and the state of the art.

What is claimed is:

1. Shoe structure comprising a first subset (10) apt to form a foot-containing structure and a second subset (20) which can be coupled to the first subset (10) and apt to isolate, at least partially, the foot sole from the ground, characterized in that said first subset (10) comprises a first insole (11), at least partially made of an elastically deformable material, and one or more edges (12) at least partially made of an elastically deformable material, extending from said first insole (11) and defining a shoe upper which can at least partially wrap the foot upper portion, and characterized in that said second subset comprises a supporting framework (21), at least partially made of an elastically deformable material and having an upper face (210) which can be coupled to said first subset (10) and a lower face (211) with one or more inserts (22) which are intended to be in contact with the ground.

2. Shoe structure according to claim 1, characterized in that said one or more edges (12) are united to said first insole (11) in a position corresponding to its external edge (110).

3. Shoe structure according to claim 1, characterized in that said one or more edges (12) are connected to said first insole (11) by means of a Strobel sewing made of an at least partially elastic thread.

4. Shoe structure according to claim 1, characterized in that said one or more edges (12) are connected to said first insole (11) by glueing.

5. Shoe structure according to claim 1, characterized in that said one or more edges (12) extend beyond the foot, also wrapping the leg lower portion.

6. Shoe structure according to claim 1, characterized in that said supporting framework (21) comprises a basis (23) and a grid (24) placed on the lower face (211).

7. Shoe structure according to claim 6, characterized in that said grid (24) forms a plurality of seats (25) apt to accommodate said inserts (22).

8. Shoe structure according to claim 6, characterized in that said basis (23) and said grid (24) form a single body.

9. Shoe structure according to claim 1, characterized in that at least a part of said inserts (22) IS made of an highly abrasion-resistant material.

10. Shoe structure according to claim 1, characterized in that at least a part of said inserts (22) is made of an elastomeric material.

11. Shoe structure according to claim 1, characterized in that said first insole (11) is directly coupled to the upper face (210) of said supporting framework (21).

12. Shoe structure according to claim 1, characterized in that it comprises a heel-supporting element.

13. Shoe structure according to claim 12, characterized in that said heel-supporting element (30) forms a seat (32) apt to accommodate a shock-adsorbing element (31).

14. Shoe structure according to claim 12, characterized in that said heel-supporting element (30) is interposed between said first insole (11) and the upper face (210) of said supporting framework.

15. Shoe structure according to claim 12, characterized in that said heel-supporting element (3) is placed inside said first subset (10) in a position corresponding to said first insole (11).

16. Method for producing a shoe structure according to one or more of the previous claims, characterized in that it comprises, in any order, the following steps:

a) providing said first subset (10);

b) providing said second subset (20); and then the following step:

c) assembling of said first subset (10) and said second subset (20), said step a) comprising, in any order, the following steps:

a.1) definition and/or assembling of one or more edges (12), at least partially made of elastically deformable material, in order to obtain a shoe upper which can at least partially wrap the foot upper portion;

a.2) definition of a first insole (11) at least partially made of an elastically deformable material;

and then:

a.3) assembling of said insole (11) with said edges (12) in order to obtain a foot-containing structure;

said step b) comprising, in any order, the following steps:

b.1) providing one or more inserts (22) apt to be in contact with the ground;

b.2) providing a supporting framework (21) having an upper face (210) which can be coupled to said first subset (10) and a lower face which can be coupled to said one or more inserts (22), said supporting framework (21) being at least partially made of an elastically deformable material; and then b.3) assembling of said supporting framework (21) to said one or more inserts (22).

17. Method according to claim 16, characterized in that said step c) comprises the following steps:

c.1) assembling of a third supporting insole (111) to the first subset (10), in a position corresponding to the internal surface of the first insole (11);

c.2) coupling the first subset (10) and the second subset (20);

and possibly:

c.3) removal of said supporting insole (111).

18. Method according to claim 16, characterized in that said step b.3) takes place by hot pressing in an open mould and is followed by a step b.4), wherein the this obtained structure is vulcanized.

19. Shoe sole structure, comprising a supporting framework (21), at least partially made of an elastically deformable material and having an upper face (210) which can be coupled to the body of said shoe and a lower face (211) with a plurality of inserts (22) which are intended to be in contact with the ground.

20. Shoe sole structure according to claim 19, characterized in that said supporting framework (21) comprises a basis (23) and a grid (24) placed on the lower face (211).

21. Shoe sole structure according to claim 20, characterized in that said grid (24) forms a plurality of seats (25) apt to accommodate said inserts (22).

22. Shoe sole structure according to claim 20, characterized in that said basis (23) and said grid (24) form a single body.

23. Shoe sole structure according to claim 19, characterized in that at least a part of said inserts (22) are made of a highly abrasion-resistant material.

24. Shoe sole structure according to claim 19, characterized in that at least a part of said inserts (22) are made of an elastomeric material.

* * * * *

UNITED STATES PATENT AND TRADEMARK OFFICE

CERTIFICATE OF CORRECTION

PATENT NO. : 6,836,979 B2
APPLICATION NO. : 10/435630
DATED : January 4, 2005
INVENTOR(S) : Flavio et al.

It is certified that error appears in the above-identified patent and that said Letters Patent is hereby corrected as shown below:

on Title page (item (76):) "Bacchiega Flavio" should read --Flavio Bacchiega-- and "Calvani Romano" should read --Romano Calvani-- on Title page (item (22):) "May 10, 2003" should read --May 9, 2003--.

Signed and Sealed this

Twenty-ninth Day of August, 2006

JON W. DUDAS
*Director of the United States Patent and Trademark Office*